United States Patent [19]

Nakano et al.

[11] 4,094,282

[45] June 13, 1978

[54] IGNITION TIMING CONTROL APPARATUS FOR ENGINE DURING WARM-UP

[75] Inventors: Teruyuki Nakano, Tokyo; Syoichi Otaka, Miyoshi, both of Japan

[73] Assignee: Honda Giken Kogyo Kabushiki Kaisha, Tokyo, Japan

[21] Appl. No.: 771,107

[22] Filed: Feb. 23, 1977

[30] Foreign Application Priority Data

Feb. 25, 1976 Japan ..... 51-20431[U]

[51] Int. Cl.[2] ..... F02P 5/12

[52] U.S. Cl. ..... 123/117 A

[58] Field of Search ..... 123/117 A

[56] References Cited

U.S. PATENT DOCUMENTS

| | | | |
|---|---|---|---|
| 3,631,845 | 1/1972 | Walker et al. | 123/117 A |
| ;3,687,120 | 8/1972 | Lenz | 123/117 A |
| 3,978,831 | 9/1976 | Yoshikawa | 123/117 A |
| 3,994,269 | 11/1976 | Takaoka et al. | 123/117 A |
| 4,016,844 | 4/1977 | Tanaka et al. | 123/117 A |
| 4,022,169 | 5/1977 | Tanaka et al. | 123/117 A |

*Primary Examiner*—Carlton R. Croyle
*Assistant Examiner*—Michael Koczo, Jr.
*Attorney, Agent, or Firm*—Lyon & Lyon

[57] ABSTRACT

An ignition timing control system for internal combustion engines during warm-up utilizes opposed chambers separated by a flexible diaphragm to control movement of a rod to advance or retard the ignition timing. Temperature responsive electric switches energize electromagnetic valves to control vacuum pressures in said chambers, so that as a cold engine warms up, the ignition timing changes from advance to retard in a series of steps.

5 Claims, 4 Drawing Figures

IGNITION TIMING CONTROL APPARATUS FOR ENGINE DURING WARM-UP

In conventional engine warm-up systems involving ignition timing controls, there is a tendency to over control immediately before completion of warm-up; that is, the ignition timing tends to remain advanced for a longer period than is required.

The present system minimizes such disadvantage by providing a pneumatic actuator having opposed chambers separated by a diaphragm connected to a rod which advances or retards the ignition timing, the actuator being initially controlled by a first solenoid valve and a temperature responsive switch which remains closed when the engine temperature is low, to cause the actuator to advance the ignition timing. A second solenoid valve and second switch which closes at a higher engine temperature acts to retard the ignition timing.

Other and more detailed objects and advantages will appear hereinafter.

Figure 1A:
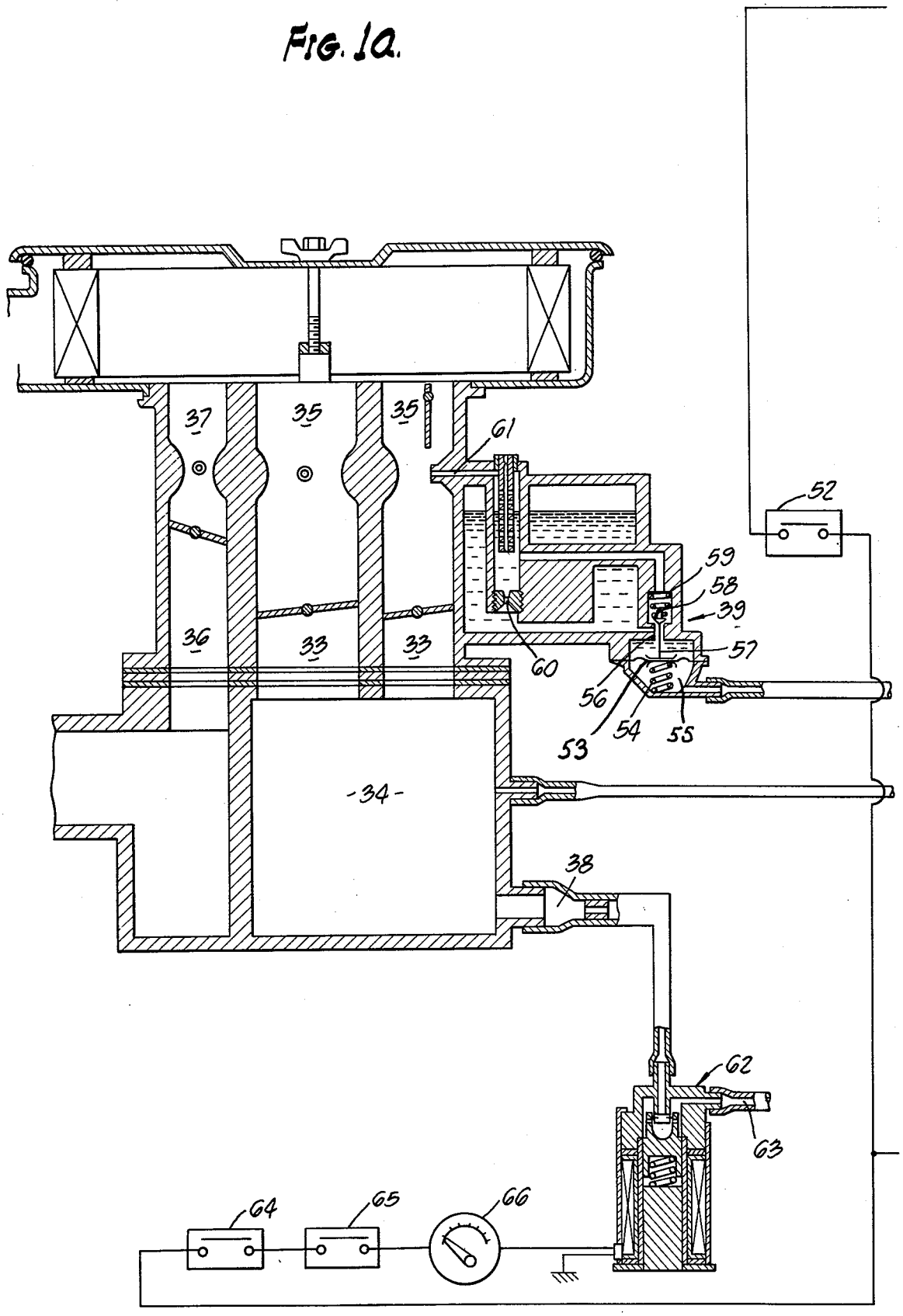

FIG. 1*a* is an essentially diagrammatic view of a carburetor suitable for use with the ignition timing control system.

Figure 1B:
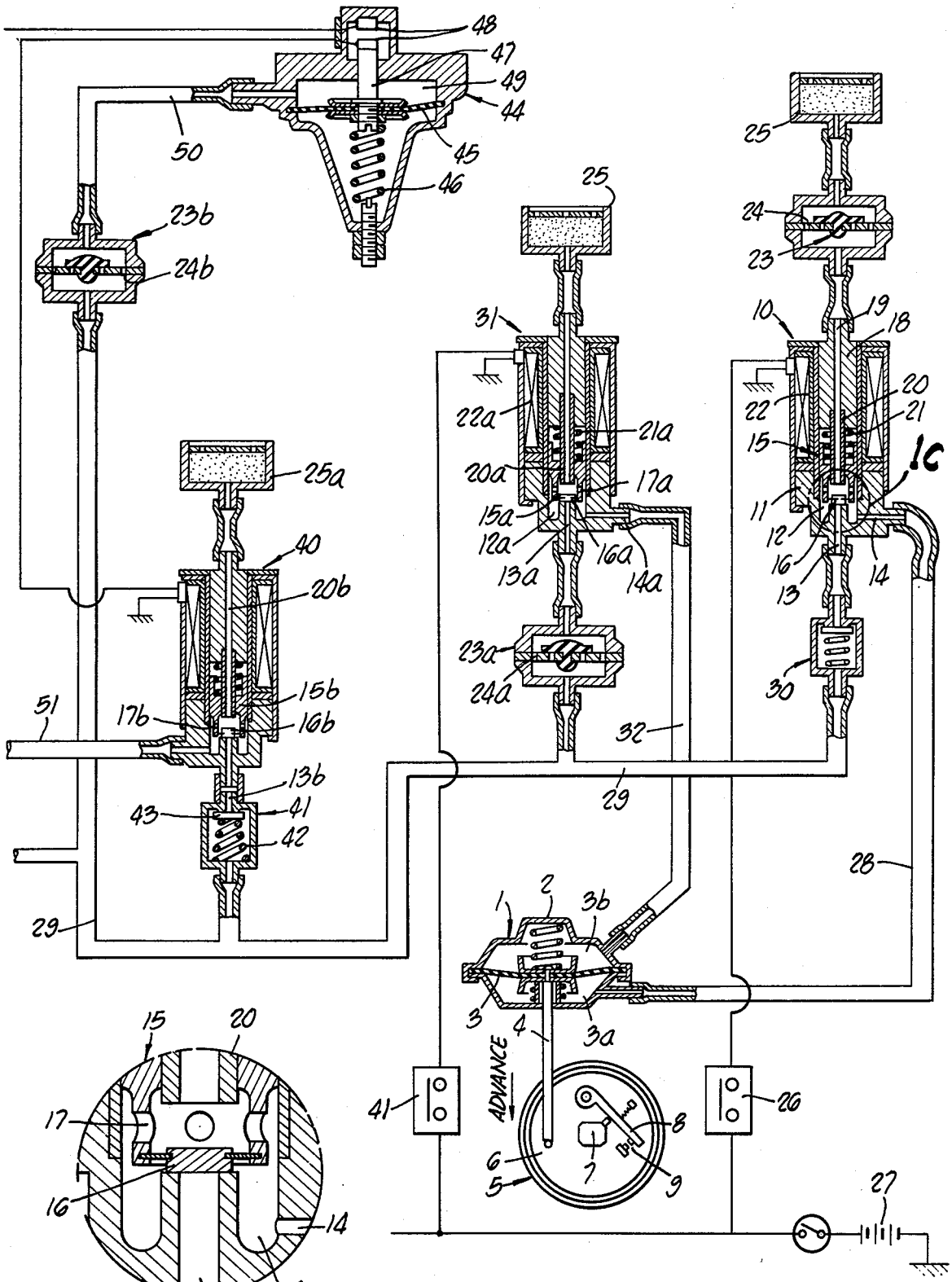

FIG. 1*b* is an essentially diagrammatic view indicating the relationship of the various components of the ignition timing control system.

Figure 1C:
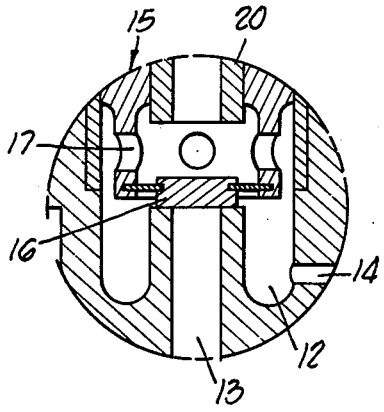

FIG. 1*c* is an enlarged fragmentary sectional view taken within circle 1*c* of FIG. 1*b*.

Figure 2:
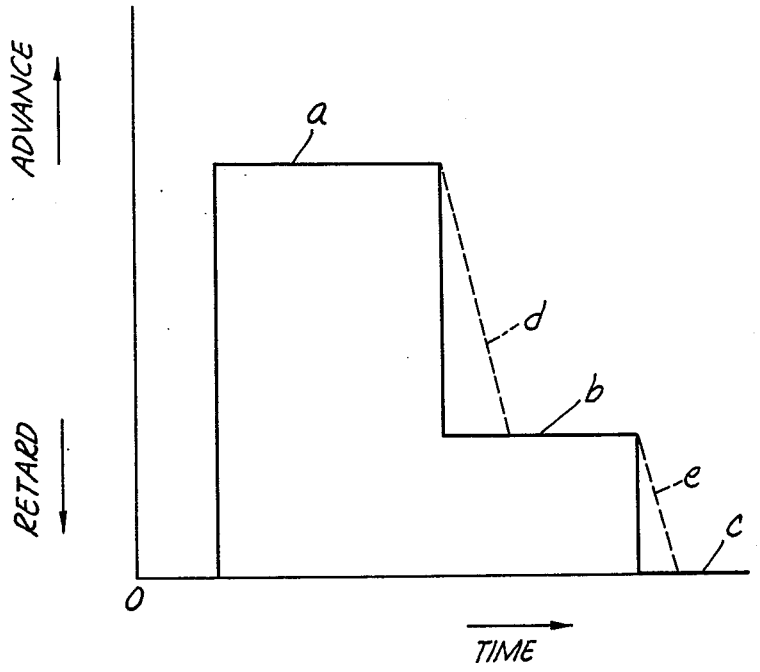

FIG. 2 is an explanatory diagram indicating the sequence of operation.

The ignition timing control device utilizes an actuator 1 including a housing 2 having a flexible diaphragm 3 therein attached to a rod 4 which extends from the actuator to a conventional ignition timing device 5 having a pivotal base 6. Centered on the pivotal base 6 is a rotary cam 7 which engages an arm 8 having contacts 9. The cam is rotated by the engine. The diaphragm 3 divides the housing 2 to form therewith a first or advancing chamber **3*a* and a second or retracting chamber 3*b***.

The actuator 1 is connected by a first electromagnetic valve 10 which includes a valve body 11 forming a valve chamber 12 having a suction passage 13 at its lower end and a laterally extending terminal 14. Disposed in coaxial relation to the valve chamber 12 is a tubular armature 15, the lower end of which is closed by valve disc 16. Immediately above the valve disc 16, the armature 15 is provided with ports 17. (See FIG. 1*c*.)

The armature 15 is disposed in coaxial relation with a solenoid core 18 which is tubular and which encircles the inlet 19 exposed to atmospheric pressure. A tube 20 extends downwardly from the core 18 and confronts the valve disc 16. A spring 21 urges the armature 15 and its valve disc 16 axially with respect to the tube 20. The core 18 is surrounded by a solenoid coil 22. The inlet 19 is connected to a check valve 23 which is bypassed by diffuser passages 24 so that pressure across the check valve tends to reach an equilibrium. Beyond the check valve 23 there is provided a filter 25.

The solenoid 22 is energized through a temperature sensitive switch 26 connected to a battery 27 or other electrical source. By way of example by not limitation, the temperature sensitive switch 26 remains closed until the engine coolant temperature reaches approximately 50° C.

The first valve 10 is connected by its port 14 and a line 28 to the lower chamber **3*a*** of the actuator as viewed in FIG. 1*b*. The first valve 10 is also connected by its vacuum passage 13 to a vacuum line 29 leading from a source of vacuum pressure such as is available in the intake passage from the carburetor to the engine. The line 129 is provided adjacent the first valve 10 with a check valve 30.

A second electromagnetic valve 31 is provided which is identical to the first electromagnetic valve 10, and similar reference numbers with the suffix "*a*" are used to designate the components thereof. The second valve 31 is connected by its port **14*a* to a line 32 connecting the upper chamber 3*b* of the actuator 1. The second valve 31 is connected to the vacuum line 29. Interposed between the second valve 31 and the vacuum line 29 is a check valve 23*a* having diffuser bypass passages 24*a***.

Referring to FIG. 1*a*, which shows a carburetor suitable for use with the ignition timing control system, the carburetor includes intake passages 33 which connect to a chamber 34 constituting a vacuum pressure source. The intake passage 33 is connected to a main carburetor 35. The type of carburetor illustrated also includes an auxiliary intake passage 36, and auxiliary carburetor 37. The carburetor illustrated also includes a secondary air inlet 38 and may be provided with an additional fuel feed system 39.

The operation of the ignition timing control system is as follows:

At temperatures below about 50° C, the switch 26 remains closed, and the electromagnetic valve 10 opens to connect passage 13 to port 14. Thus, the lower chamber **3*a* is connected to vacuum pressure line 29. The switch 41 remains open at low temperatures of engine coolant, and therefore the second electromagnetic valve 31** remains in the position shown in FIG. 1*b*. Accordingly, the upper chamber **3*b*** is vented to atmosphere.

With the lower chamber **3*a* subjected to vacuum pressure and the upper chamber 3*b* vented to atmosphere, the diaphragm 3 projects the rod 4** to advance the spark timing. This condition is shown by line "*a*" in FIG. 2.

When the engine coolant temperature increases to a level between 50° C and 75° C, the temperature sensitive switch 26 is open and the temperature sensitive switch 41 remains open. Both of the chambers **3*a* and 3*b*** are vented to atmosphere, and this condition is shown by the line "*b*" in FIG. 2. The ignition timing is at an intermediate position between advance and retard. When the engine coolant temperature exceeds about 75° C, the switch 41 closes, energizing the second electromagnetic valve 31 so that the upper chamber **3*b* is connected to the vacuum line 29**.

The lower chamber **3*a* is vented to atmosphere, and accordingly the rod 4** retracts to retard the spark timing. This condition is shown by the line "*c*" in FIG. 2.

The diffused bypass passages 24 of the check valve 23 and the diffused bypass passages **24*a* of the check valve 23*a* permit slow flow through the devices when the respective check valves are in closed position. Thus, flow of atmospheric air through the filter 25 and passage 19, port 14 and line 28 to lower chamber 3*a*** occurs gradually. This is shown by the dashed line "*d*" in FIG. 2. Similarly, suction pressure from line 29 acts gradually through passage **13*a*, port 14*a* and line 32 to the upper chamber 3*b***. This is shown by the dashed line "*e*" in FIG. 2. Sudden change in the position of the actuator rod 4 is thus minimized.

In the foregoing description, the first temperature sensitive switch 26 is of the type which closes at temperatures below 50° C, and the second temperature responsive switch 41 is of the type that closes when the temperature exceeds about 75° C. However, the device of this invention is not limited to this arrangement alone, but similar results can be achieved by employing a first switch 26 which closes at temperatures of 75° C and lower, and employing a second switch 41 of the type that closes at 50° C and above. When switches of these types are employed, rising temperature causes the first switch 26 to close, and upon further increase in temperature the second switch 41 also closes, and subsequently the first switch 26 opens. In operation, with switches of this type, the first switch 26 closes during the initial period of engine warm-up, and this causes the first electromagnetic valve 10 to introduce vacuum pressure into the lower chamber 3*a* to advance the ignition timing. When the temperature rises to close the second switch 41, the vacuum is also introduced to the upper chamber 3*b* so that a pressure difference between the two chambers ceases to exist, causing the ignition timing device 5 to take an intermediate positon between advance and retard. Further, as the temperature continues to rise, the first switch 26 opens, causing the electromagnetic valve 10 to vent the chamber 3*a* to atmosphere, with the result that the ignition timing is retarded.

It will be understood that with the temperature responsive switches 26 and 41 operating in either of the modes described above, the engine operates with proper combustion during the warm-up period and warming up is completed in a short time.

The additional fuel feed device 39 employs a valve 58 connected to diaphragm 53 by means of rod 57 to open fuel passage 56 against the force of spring 59 when vacuum pressure in a chamber 55 is decreased. The chamber 55 communicates by means of a third electromagnetic valve 40 to the vacuum line 29 through check valve 41 or to atmosphere through the filter 25*a*.

When the third valve 40 is not energized, the chamber 55 communicates to atmosphere through the third valve 40 and filter 25*a* so that the valve 58 opens the fuel passage 56 and additional fuel is fed to main fuel nozzle 61, joining the fuel from main fuel jet 60, on its way to the nozzle 61. The third valve 40 is energized when both temperature switch 52 and contact points 48 of pressure sensitive switch 44 are closed. The temperature switch 52 is closed when engine coolant temperature or engine lubricant temperature goes over 50 degrees C. When vacuum pressure acting on diaphragm 45 is increased, overcoming the force of spring 46, activating rod 47 connected to diaphragm 45 is moved upward, thus connecting contact point 48.

Between vacuum line 29 and vacuum line 50 is provided check valve 23*b*, so that the suction vacuum pressure from line 29 acts gradually through line 50 to chamber 49 of pressure sensitive switch 44. The check valve 23*b* is directed to create some delay in transmitting vacuum intensity produced in intake chamber 34 to chamber 49, so that gradual increase in vacuum intensity is achieved. Accordingly, in the engine fueled by a lean mixture, feeding additional fuel and advancing ignition timing brings advantageous effects such as desirable combustion and low emission during the warm-up period.

If suction vacuum in chamber 34 is low and engine temperature is relatively high, e.g. at a time when engine is re-started shortly after the engine is shut off following a longtime operation, additional fuel is continuously fed to main fuel nozzle 61 by the additional fuel feed devcie 39 until vacuum pressure intensity acting on diaphragm 45 reaches a certain level. Additional fuel feeding for the hot start conditions is needed because vaporized fuel still remains in the intake passage 33, and is drawn simultaneously as the hot engine starts. The mixture supplied anew to the combustion chambers becomes leaner than the predetermined air-fuel ratio for a while, because insufficient fuel vaporization takes place as fuel in the mixture adheres to the walls of the intake passage 33 and chamber 34. The additional fuel richens the mixture to prevent engine misfire.

The secondary air supplying control valve 62 is actuated when deceleration sensing switch 64, engine oil temperature switch 65 and vehicle speed switch 66 are all closed. Oil temprature switch 65 is closed when engine temperature goes up to 50° C and more vehicle speed switch 66 is closed when vehicle speed reaches 15 km/h and over.

Having fully described our invention, it is to be understood that we are to be limited to the details herein set forth but that our invention is of the full scope of the appended claims.

We claim:

1. In an ignition timing control device for an internal combustion engine during warm-up, the engine having an intake passage, the combination of: an ignition timing device for the engine, an actuator for said device having two vacuum chambers separated by a flexible diaphragm, first means including a first valve for subjecting the first of said chambers to atmospheric pressure or to suction pressure from said engine intake passage, second means including a second valve for subjecting the second of said vacuum chambers to atmospheric pressure or to suction pressure from said intake passage, a first temperature responsive mechanism controlling operation of said first valve so that below a first predetermined temperature said first valve causes suction pressure to be introduced into said first chamber, a second temperature responsive mechanism controlling operation of said second valve so that above a second predetermined temperature said second valve causes suction pressure to be introduced into said second chamber, whereby increasing engine temperature during warm-up first causes differential pressure across said diaphragm to advance the ignition timing, then equalizes pressure across said diaphragm to place the ignition timing at a value between retard and advance, and finally causes differential pressure across said diaphragm to retard the ignition timing.

2. The combination set forth in claim 1 in which both valves operate to subject opposite sides of the diaphragm to suction pressure when the temperature of the engine is between said two predetermined temperatures.

3. The combination set forth in claim 1 in which both valves operate to subject opposite sides of the diaphragm to atmospheric pressure when the temperature of the engine is between said two predetermined temperatures.

4. The combination set forth in claim 1 in which said mechanisms each comprise an electric switch and said valves are each operated electromagnetically.

5. In an ignition timing control device for an internal combustion engine during warm-up, the engine having an intake passage, and also having a coolant therein, the combination of: an ignition timing device for the engine, an actuator for said device having two vacuum chambers separated by a flexible diaphragm, first means including an electromagnetic valve for subjecting the first of said chambers to atmospheric pressure or to suction pressure from said engine intake passage, second means including an electromagnetic valve for subjecting the second of said vacuum chambers to atmospheric pressure or to suction pressure from said intake passage, a first electrical switch responsive to engine coolant temperature controlling operation of said first valve so that below a first predetermined temperature said first valve causes suction pressure to be introduced into said first chamber, a second electrical switch responsive to engine coolant temperatures controlling operation of said second valve so that above a second predetermined temperature said second valve causes suction pressure to be introduced into said second chamber, whereby increasing engine temperature during warm-up first causes differential pressure across said diaphragm to advance the ignition timing, then equalizes pressure across said diaphragm to place the ignition timing at a value between retard and advance, and finally causes differential pressure across said diaphragm to retard the ignition timing.

* * * * *

UNITED STATES PATENT AND TRADEMARK OFFICE

CERTIFICATE OF CORRECTION

PATENT NO. : 4,094,282

DATED : June 13, 1978

INVENTOR(S) : Teruyuki Nakano et al

It is certified that error appears in the above-identified patent and that said Letters Patent are hereby corrected as shown below:

Column 2, line 5, numeral "129" should read --29--.

Column 3, line 53, "point" should read --points--.

Column 4, line 3, "device" is misspelled.

Column 4, line 22, between "are" and "to" insert word --not--.

Signed and Sealed this

*Nineteenth* Day of *December 1978*

[SEAL]

*Attest:*

RUTH C. MASON
*Attesting Officer*

DONALD W. BANNER
*Commissioner of Patents and Trademarks*